United States Patent [19]

Azbukin et al.

[11] 4,299,623

[45] Nov. 10, 1981

[54] CORROSION-RESISTANT WELDABLE MARTENSITIC STAINLESS STEEL, PROCESS FOR THE MANUFACTURE THEREOF AND ARTICLES

[76] Inventors: Vladimir G. Azbukin, Iskrovsky prospekt, 28, kv. 430; Jury F. Balandin, ulitsa Basseinaya, 117, korpus 1, kv. 85; Igor V. Gorynin, ulitsa Gromova, 16, kv. 50; Lev Y. Gluskin, ulitsa Grafova, 2, kv. 37; Jury I. Zvezdin, Kostromskoi prospekt, 42, kv. 23; Alexandr G. Ignatenko, Grazhdansky prospekt, 23/2, kv. 74; Alexandr N. Krasnov, ulitsa Shotmana, 4, kv. 203, all of Leningrad; Rostislav K. Melekhov, ulitsa Ugorskaya, 27, kv. 10, Lvov; Inna S. Osipova, ulitsa Ryleeva, 21, kv. 9, Leningrad; Valery N. Pavlov, Dmitrovsky pereulok, 11, kv. 16, Leningrad; Alexandr A. Khokhlov, ulitsa Karpinskogo, 23/1, kv. 15, Leningrad; Ivan A. Stepanov, ulitsa Chaikovskogo, 33, kv. 30, Leningrad; Alexandr F. Anfimov, ulitsa Ushinskogo, 7, korpus 1, kv. 39, Leningrad; Vasily V. Ardentov, ulitsa Gromova, 16, kv. 43, Leningrad; Viktor M. Burmakin, ulitsa Sedova, 86, kv. 199, Leningrad; Viktor A. Ignatov, ulitsa Sofii Kovalevskoi, 10, korpus 2, kv. 169, Leningrad; Eduard A. Rokhlin, Varshavskaya ulitsa, 58, kv. 91, Leningrad; Vladimir V. Zhitkov, Promyshlennaya ulitsa, 38, kv. 66, Leningrad, all of U.S.S.R.

[21] Appl. No.: 91,157

[22] Filed: Nov. 5, 1979

[51] Int. Cl.[3] ..... C22C 38/40; C22C 38/48; C22C 38/50

[52] U.S. Cl. ..... 75/128 R; 75/128 E; 75/128 G; 75/128 Z; 148/37

[58] Field of Search ..... 75/128 R, 128 G, 128 Z, 75/128 E, 126 F; 148/12 E, 12 EA, 37, 38, 3, 136

[56] References Cited

U.S. PATENT DOCUMENTS

| | | | |
|---|---|---|---|
| 3,258,370 | 6/1966 | Floreen et al. | 148/12 E |
| 3,259,528 | 7/1966 | Carlsen | 148/37 |
| 3,355,280 | 11/1967 | Tuffnell et al. | 148/37 X |
| 3,622,307 | 11/1971 | Clarke, Jr. | 75/128 R |
| 3,649,252 | 3/1972 | Kirkby et al. | 75/128 G |
| 3,926,622 | 12/1975 | Kiyonaga et al. | 75/128 E X |

FOREIGN PATENT DOCUMENTS

| | | | |
|---|---|---|---|
| 52-30213 | 3/1977 | Japan | 75/128 E |
| 341859 | 6/1972 | U.S.S.R. | 75/128 E |
| 589280 | 1/1978 | U.S.S.R. | 75/128 E |
| 620509 | 8/1978 | U.S.S.R. | 75/128 E |

*Primary Examiner*—Peter K. Skiff
*Attorney, Agent, or Firm*—Steinberg and Raskin

[57] ABSTRACT

A corrosion-resistant weldable martensitic steel essentially consists of carbon 0.06 to 0.10 weight percent, chromium 15.1 to 16.5 weight percent, nickel 3.5 to 4.45 weight percent, silicon 0.10 to 0.60 weight percent, manganese 0.20 to 0.50 weight percent, at least one element selected from the group consisting of niobium 0.25 to 0.40 weight percent and zirconium 0.05 to 0.20 weight percent, at least one element selected from the group consisting of yttrium 0.05 to 0.20 weight percent, cerium 0.05 to 0.15 weight percent and lanthanum 0.05 to 0.15 weight percent, phosphorus not exceeding 0.025 weight percent, sulfur not exceeding 0.02 weight percent, copper not exceeding 0.20 weight percent, the remainder being substantially iron and unavoidable nonferrous impurities. The process for the manufacture of the steel comprises the steps of preparing a molten mass of said composition, pouring the molten mass into a mould and permitting it to solidify therein followed by cooling an ingot produced. The cooling step is carried out in at least two stages, the first stage residing in cooling the ingot to a temperature laying in martensite transformation start-end interval but not lower than to 100° C., and then in its immediate heating up to tempering temperatures in the range from 600° to 650° C., whereas each subsequent stage comprises cooling the ingot to martensite transformation temperatures but by at least 50° C. lower than the cooling temperature of the previous stage, thus bringing, with such a multistage cooling, the temperature of the ingot down to a value below the temperature of the end of martensite transformation, followed by final tempering in the temperature range of 600° to 650° C. and subsequent cooling to room temperature.

4 Claims, 15 Drawing Figures

%
50
45
40
35
30
25
20
15
10
5

%
50
45
40
35
30
25
20
15
10
5

CORROSION-RESISTANT WELDABLE MARTENSITIC STAINLESS STEEL, PROCESS FOR THE MANUFACTURE THEREOF AND ARTICLES

FIELD OF THE INVENTION

The present invention relates to metallurgy, and more specifically to a corrosion-resistant weldable martensitic steel, process for the manufacture thereof and articles produced of that steel.

The present invention can be used to best advantage in all arts where a need exists in use of large-sized parts and construction units subjected to considerable stresses and to corrosive attack at normal and raised temperatures as up to 350° C. Also, the present invention can be used to best advantage in arts where a need exists to use high strength corrosion-resistant structural steels which show no deterioration in mechanical and corrosion-resistant properties after being subjected to welding.

BACKGROUND OF THE INVENTION

As a guide to a better understanding of certain features of the present invention, it may be noted that at the present time there is a wide variety of corrosion-resistant steels available to the art. The selection of any particular grade by the user largely depends upon the combination of characteristics sought, namely, mechanical properties, corrosion cracking resistance, intercrystalline corrosion resistance, workability etc.

Most of practical advantages of these steels depends on both chemical composition of steel and process for the manufacture thereof, and more particularly such an important step of the process as thermal treatment.

Steels used in welded constructions of large dimensions subjected to considerable stresses and aggressive medium attacks are to meet especially rigid requirements. Such steels must show a high level of strength properties, corrosion cracking resistance and intercrystalline corrosion resistance. Yet, such steels must possess good plasticity sufficient to lend themselves to a variety of forming and machining technological operations.

There is well known and widely used a corrosion-resistant martensitic steel containing in weight percent: carbon, 0.20; manganese, 1.00; silicon, 1.00; phosphorus, 0.040; sulphur, 0.030; chromium, 15.00 to 17.00; nickel 1.25 to 2.50; and remainder iron. This steel is comparatively inexpensive. After hardening from 1050° C. and temper at 315° C. this steel has a tensile strength of 140 kgf/mm$^2$ and 0.2 percent yield strength of 98 kgf/mm$^2$. As a result, this steel is suitable for such parts as spindles, gears, racks etc. However, the steels of the type described show extremely unstable structure. Up to 40 percent of delta-ferrite may be contained in the steel structure according to its chemical composition variations. This leads to deterioration of forgeability and ductility, to considerable decrease of transverse impact strength, and to increase of mechanical anisotropy. Again, stressed parts made of said steel are subjected to intensive corrosion cracking when maintained in aggressive media (for example, hot strong chloride solution).

There is also known a corrosion-resistant austenitic steel containing in weight percent: carbon, 0.08; manganese, 2.00; silicon, 1.00; phosphorus, 0.045; sulphur 0.030; chromium, 17.0 to 19.0; nickel, 9.0 to 12.0; titanium to carbon ratio being at least 5 to 1; remainder iron. Said steel shows rather high ductility and good workability. Forged pieces and bars have in austenitic state (austenitization at 1050° C.) a tensile strength of 53 kgf/mm$^2$, a 0.2 percent yield strength of 21 kgf/mm$^2$, an elongation of 40 percent and a reduction in area of 50 percent. This grade of steel is costly, however, because of the rather high alloy content, particularly because of large amount of nickel used therein. Moreover, said steel has a low strength level and an inclination to corrosion cracking, particularly when chlorides accumulation takes place.

There is known an austenitic alloy of high nickel content, which alloy contains in weight percent: carbon, 0.10; manganese, 1.50; silicon 1.00; chromium, 19.0 to 23.0; nickel 30.0 to 35.0; titanium, 0.15 to 0.60; remainder iron. This alloy possesses a high corrosion cracking resistance in strong chloride solutions (42 percent $MgCl_2$ solution boiling at 154° C., or 0.5 percent NaCl solution boiling at 100° C., etc.). Its mechanical properties are about the same as the corrosion-resistant austenitic steel, being a bit less ductile. Tubes manufactured of said type alloy of high nickel content have in austenitic state a tensile strength of 49 kgf/mm$^2$, a 0.1 percent yield strength of 21 kgf/mm$^2$, an elongation of 30 percent. But said type alloy is even more expensive than the austenitic steel mentioned hereinabove because of significantly higher nickel content.

There is also known a corrosion-resistant ferritic steel containing in weight percent: carbon, 0.08; manganese, 1.00; silicon, 1.00; phosphorus, 0.040; sulphur, 0.030; chromium, 11.5 to 14.5; remainder iron. Said steel is of less cost than the corrosion-resistant austenitic steel mentioned above. However, said type steel has a low workability due to elevated overheating sensitivity and inclination to heat embrittlement.

Weldability is one of the important characteristics of steel. The austenitic steels are easily weldable, but they have disadvantages described hereinbefore. The alloys of high nickel content are difficult to weld due to cracks appearing at the near-to-weld zone. Overheating-sensitive ferritic steels fail to provide impact strength of required values due to intensive grain growth.

It is generally required on welding the martensitic steels to preheat the parts to be welded up to temper temperatures ranging from 200° to 300° C. in order to keep them free from cold hardening cracks appearance. This results in considerable complexity and expensiveness of weld process of the martensitic steels.

A group of high-strength corrosion-resistant steels with reversible adjustable transformation on temper of tempered martensite to austenite ($\alpha \rightarrow \gamma$) have been recently developed. Said steels enjoy a successful combination of high tensile strength inherent in martensitic steels and good ductility, toughness and workability inherent in austenitic steels. One of these steels (cf. "Transaction ASM" 62, No. 4, 1969, pp. 902–914) contains in weight percent: carbon, 0.10; manganese, 0.40 to 0.90; silicon, 0.20 to 0.80; chromium, 11.5 to 13.5; nickel 5.0 to 6.5; molybdenum, 1.2 to 2.0; remainder iron. Said steel provides for forged pieces having a tensile strength of 85 kgf/mm$^2$, a 0.2 percent yield strength of 63 kgf/mm$^2$, an elongation of 15 to 18 percent, a reduction in area of 50 percent and a Charpy test impact energy level of 11 kgf.m.

To develop such properties of the steel the method of manufacture of the steel, and particularly the thermal treatment step thereof contributes greatly.

The process for the manufacture of such a steel resides in preparing a molten mass, pouring the molten mass into a mould and permitting it to solidify therein followed by cooling an ingot produced.

The ingot or forged piece is then subjected to thermal treatment comprising hardening constituting an oil or air cooling, and high temper, which result in developing up to 30 percent of austenite in the structure.

However, the field of usefulness of such a seel is rather limited due to lack of austenite stability at low-temperature heatings. Austenite developed in the structure of articles is destabilizated with prolonged heating at a temperature of 300° to 350° C. and upon cooling the articles to room temperature it is transformated into untempered martensite, which results in decrease of the impact strength and inclination of the steel to corrosion cracking.

Moreover, temper at 590°-600° C. used for said steel to develop a maximum of austenite in the structure fails to fully relieve them from residual stresses after hardening. The residual stresses of a high level constitute a danger of crack formation on cooling ingots, forged pieces and articles of large dimensions fabricated of these steels.

SUMMARY OF THE INVENTION

It is accordingly among the principal objects of the present invention to provide a corrosion-resistant weldable martensitic steel, a process for the manufacture thereof and articles produced of this steel, for avoiding the aforesaid drawbacks of the prior art.

Another object of the present invention is to provide a corrosion-resistant weldable martensitic steel and a process for the manufacture thereof, both enabling to ensure high mechanical properties of articles produced of this steel.

Still another object of the present invention is to provide a corrosion-resistant weldable martensitic steel and a process for the manufacture thereof enabling to ensure high intercrystalline corrosion resistance and corrosion cracking resistance of articles and constructions produced of this steel and disposed in water and steam at elevated temperatures and pressures, comprising chlorides and oxygen.

A further object of the present invention is to provide a corrosion-resistant weldable martensitic steel lending itself to conversion into welding wire whose use in welding of articles produced of this steel would ensure the weld joints being equistrength to the base metal and possessing high ductility, corrosion cracking resistance and intercrystalline corrosion resistance in aqueous media comprising chlorides at elevated temperatures.

The present invention will be seen to reside in the combination of elements, the composition of ingredients forming a corrosion-resistant weldable alloy, and in the process for carrying out the thermal treatment of intermediate products, all as described herein and the scope of the present invention is set forth in the claims at the end of the specification.

With above mentioned and other objects in view, there is proposed a corrosion-resistant weldable martensitic steel comprising carbon, chromium, nickel, silicon, manganese, phosphorus, sulphur and copper, which steel, according to the invention, further comprises at least one element selected from the group consisting of niobium 0.25 to 0.40 weight percent and zirconium 0.05 to 0.20 weight percent, and at least one element selected from the group consisting of yttrium 0.05 to 0.20 weight percent, cerium 0.05 to 0.15 weight percent and lanthanum 0.05 to 0.15 weight percent, the correlation of the other ingredients in percent by weight being as follows:

carbon—0.06 to 0.10;
chromium—15.1 to 16.5;
nickel—3.5 to 4.45;
silicon—0.10 to 0.60;
manganese—0.20 to 0.50;
phosphorus not exceeding—0.025;
sulphur not exceeding—0.02;
copper not exceeding—0.20;

remainder essentially iron and unavoidable nonferrous impurities.

The composition of the steel is viewed as being critical.

Any substantial departure from the ranges set out above results in a disturbance of the structure balance with a resulting sacrifice of performance characteristics.

The reasons why the chemical composition of the alloy steel according to the present invention is limited to the ranges referred to hereinafter will be explained.

In general, content of unavoidable nonferrous impurities such as tin, antimony and arsenic in the steel according to the present invention is not regulated. However, when the steel according to the present invention is used to produce parts subjected under operating conditions to neutron irradiation, it is necessary to limit each of the unavoidable nonferrous impurities by content of not more than 0.01 percent, the correlation of the ingredients, in percent by weight being as follows:

carbon—0.06 to 0.10;
chromium—15.1 to 16.5;
nickel—3.5 to 4.45;
silicon—0.05 to 0.20;
manganese—0.20 to 0.50;
niobium—0.25 to 0.40;
yttrium—0.05 to 0.10;
lanthanum—0.05 to 0.15;
phosphorus not exceeding—0.02;
sulphur not exceeding—0.015;
copper not exceeding—0.1;
remainder essentially iron.

It is expedient that a niobium to carbon ratio be 4:1 when the steel is used to produce parts and constructions which must possess of extremely high intercrystalline corrosion resistance.

Such a steel enjoys intercrystalline corrosion resistance not only after an optimum thermal treatment but also after provocative heating.

It is practicable in some instances in the proposed steel to limit a carbon content to the range from 0.06 to 0.07 weight percent and a silicon content to the range from 0.3 to 0.6 weight percent. Such a steel according to the present invention in percent by weight is as follows:

carbon—0.06 to 0.07
chromium—15.1 to 16.5;
nickel—3.5 to 4.45
silicon—0.3 to 0.6;
manganese—0.20 to 0.50;
niobium—0.25 to 0.40;
zirconium—0.05 to 0.20;
yttrium—0.05 to 0.20;
cerium—0.05 to 0.15;
phosphorus not exceeding—0.025;
sulphur not exceeding—0.02;
copper not exceeding—0.2;

remainder essentially iron and un-a-voidable nonferrous impurities.

A process for the manufacture of a corrosion-resistant weldable martensitic steel comprises the steps of preparing a molten mass, pouring the molten mass into a mould and permitting it to solidify therein followed by cooling an ingot produced, wherein, according to the invention, the step of cooling is carried out in at least two stages, the first stage residing in cooling the ingot to the temperature ranging from the temperature of the start of the martensite transformation to the temperature of the end of the martensite transformation, but not lower than to 100° C., and then in its immediate heating up to tempering temperatures in the range from 600° to 650° C., whereas each subsequent stage resides in cooling the ingot to the martensite transformation temperatures but by at least 50° C. lower than the cooling temperature of the previous stage, thus bringing with such multistage cooling the temperature of the ingot down to a value below the temperature of the end of martensite transformation, followed by final tempering in the temperature range from 600° to 650° C. and subsequent cooling to room temperature.

Such a process enables to perform multistage controlled phase transformation of austenite to martensite upon cooling from austenite temperature range to temperatures of start-end interval of martensite transformation which is interrupted with heating up to temper temperatures, thereby providing ingots enjoying a decreased level of residual stresses.

This process for the manufacture of a corrosion-resistant weldable martensitic steel is especially desirable when producing ingots of large dimensions since an ingot of large dimensions can be fractured due to residual stresses, if not being subjected to thermal treatment according to said process.

It is also practicable to use multistage phase transformation of austenite to martensite according to the present invention, when producing articles of corrosion-resistant weldable martensitic steel, according to the present invention, by means of hot plastic working of an ingot.

Such method for the manufacture of articles of a corrosion-resistant weldable martensitic steel resides in preparing a molten mass, pouring the molten mass into a mould, permitting it to solidify therein, hot plastic working of the obtained ingot and its subsequent cooling, wherein, according to the invention, the cooling operation is carried out in at least two stages, the first stage residing in cooling the article to the temperature ranging from the temperature of the start of martensite transformation to the temperature of the end of martensite transformation, but not lower than to 100° C., and then in its immediate heating up to tempering temperatures in the range from 600° to 650° C., whereas each subsequent stage comprises cooling the article to the martensite transformation temperatures but at least by 50° C. lower than the cooling temperature of the previous stage, thus bringing with such a multistage cooling the the temperature of the article down to a value below the temperature of the end of martensite transformation, followed by final tempering in the temperature range from 600° to 650° C. and subsequent cooling to room temperature.

When practicing the method for the manufacture of articles of corrosion-resistant weldable martensitic steel according to the present invention the possibility exists of producing a wide variety of articles, such as sheet, strip, forged piece and the like.

BRIEF DESCRIPTION OF THE ACCOMPANYING DRAWINGS

The present invention will be more understood from the following detailed specification taken in conjunction with the accompanying drawings, in which:

FIG. 1 is a histogram group showing mechanical properties of a corrosion-resistant weldable martensitic steel according to the present invention from data obtained on testing 132 forged pieces fabricated of ingots of 2,8 tons in weight. The vertical axis shows frequency in percent of development of certain mechanical properties, the horizontal axis represents values of these properties. Histogram 1*a* represents the tensile strength (kgf/mm$^2$), histogram 1*b* represents the 0.2 percent yield strength (kgf/mm$^2$), histogram 1*c* represents the elongation (%), histogram 1*d* represents the reduction in area (%), and histogram 1*e* represents the impact strength (semicircular notch) (kgf.m/cm$^2$).

FIG. 2 is a histogram group showing mechanical properties of a corrosion-resistant weldable martensitic steel according to the present invention from data obtained on testing 14 forged pieces fabricated of ingots of 12.0 to 13.7 tons in weight. The vertical axis represents frequency in percent of development of certain mechanical properties, the horizontal axis represents values of these properties. Histogram 2*a* represents the tensile strength (kgf/mm$^2$), histogram 2*b* represents the 0.2 percent yield strength (kgf/mm$^2$), histogram 2*c* represents the elongation (%), histogram 2*d* represents the reduction in area (%), histogram 2*e* represents the impact strength (semicircular notch) (kgf.m/cm$^2$), histogram 2*f* represents the impact strength (V-notch) (kgf.m/cm$^2$).

FIG. 3 is a plot showing the effect of temper temperature and Nb/C rate upon inclination of a corrosion-resistant weldable steel according to the present invention to intercrystalline corrosion. The horizontal axis represents the temper temperature, the left vertical axis represents the niobium to carbon ratio (Nb/C), and the right vertical axis represents the carbon content in weight percent;

FIG. 4 represents plots showing the effect of temper temperature and various media upon the time to failure of specimens under a load. Plot 4*a* shows heats which are outside the present invention and have the niobium to carbon ratio of 0.83 to 1.75, whereas plot 4*b* shows heats with the niobium to carbon ratio of 4:1, according to the present invention. The vertical axis represents the time to failure of specimens in hours, the horizontal axis represents temper temperature in Celsius degrees, Marks. ∠, o designate distillate at a temperature of 200° to 350° C.; marks , Δ designate 0.5 percent NaCl solution at a temperature of 100° C.; marks . ,□ designate vapour of 10 percent of NaCl boiling solution at a temperature of 200° C.

These marks with arrows designate specimens being uncrushed upon the testing.

FIG. 5 is a plot showing variation of austenite content in a steel depending on heating temperature (build-up curves) and temper temperature (curves with maximum). The vertical axis represents γ-phase content in percent, the horizontal axis represents temperature in Celsius degrees.

DESCRIPTION OF THE PREFERRED EMBODIMENTS

Figures 1A, 1B, 1C, 1D, 1E:
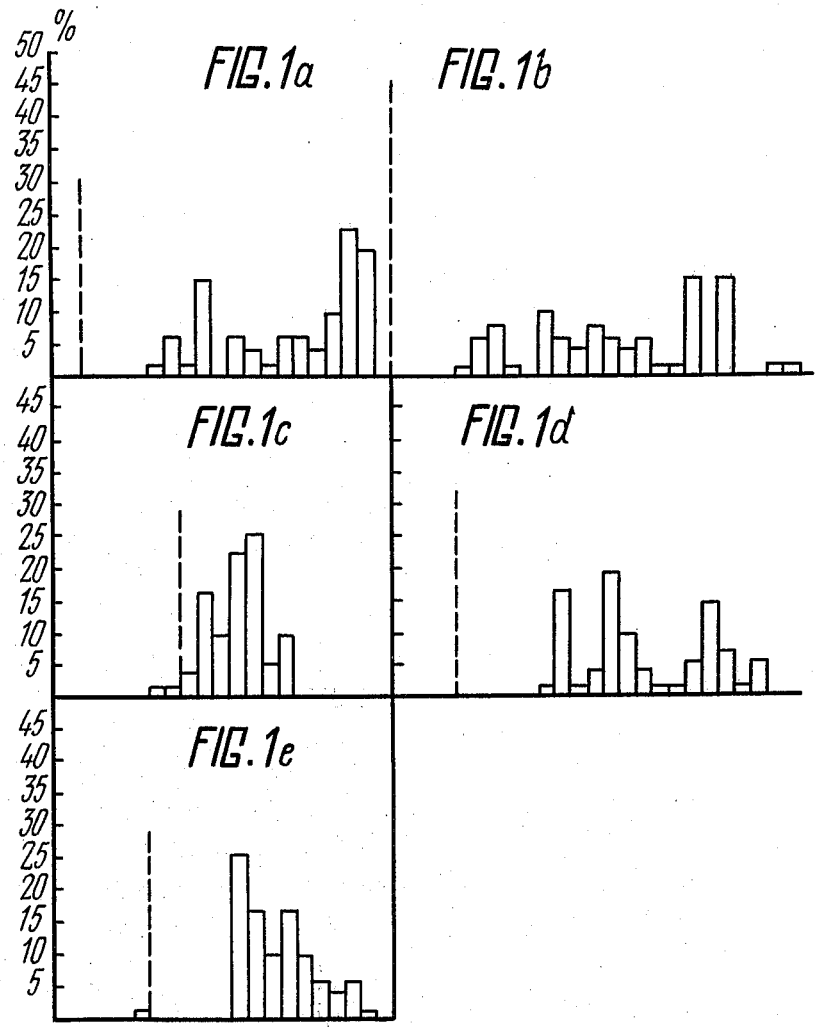

One steel according to the present invention consists of: carbon 0.06 to 0.10 percent, chromium 15.1 to 16.5 percent, nickel 3.5 to 4.5 percent, silicon 0.10 to 0.6 percent, manganese 0.2 to 0.5 percent, niobium 0.25 to 0.40 percent, yttrium 0.05 to 0.2 percent, phosphorus not exceeding 0.025, sulphur not exceeding 0.02 percent, and copper not more than 0.2 percent, remainder being substantially all iron.

Though this steel can comprise at a time all such elements improving its hot plastic workability as yttrium, cerium and lanthanum, it is desirable to add yttrium only when the steel is used for the manufacture of intermediate products of large dimensions, and that is the case when yttrium is selected from this group of metals.

From the group of metals consisting of niobium and zirconium, niobium is selected in this case for addition in this steel as a stabilizing element, thereby providing intercrystalline corrosion resistance of the material after thermal treatment.

Another steel according to the present invention essentially consists of carbon 0.06 to 0.10 percent, chromium 15.1 to 16.5 percent, silicon 0.10 to 0.20 percent, nickel 3.5 to 4.45 percent, manganese 0.2 to 0.5 percent. Niobium is added in this steel as a stabilizing element in amount of 0.25 to 0.40 percent which is sufficient to ensure intercrystalline corrosion resistance of the material after optimal thermal treatment hardening at 1050° C. and temper at 635° to 650° C. Though such elements as yttrium, cerium and lanthanum all can be present in this steel, it is desirable to add yttrium in amount of 0.05 to 0.10 percent and lanthanum in amount of 0.05 to 0.15 percent only, to improve ability of the steel to hot plastic working, which lanthanum also elevates corrosion resistance of the material under neutron irradiation. To rise irradiation embrittlement resistance there are limited strictly phosphorus, sulphur and nonferrous impurities in this steel. Phosphorus content must be not more than 0.02 percent, sulphur not more than 0.015 percent, copper not more than 0.1 percent and tin, antimony and arsenic, each, not more than 0.01 percent, remainder iron.

Still another steel according to the present invention which enjoys the best resistance to intercrystalline corrosion, essentially comprises carbon in amount of 0.06 to 0.08 percent and niobium in amount at least four times as much as carbon, i.e. 0.32 to 0.40 percent, thereby providing resistance of the steel to intercrystalline corrosion not only after optimal thermal treatment comprising hardening at 1050° C. and temper at 635° to 650° C., but also after provocative heating at 450° C. The remaining elements are in ranges indicated for the first of the aforesaid steels, i.e.: chromium 15.1 to 16.5 percent, nickel 3.5 to 4.45 percent, silicon 0.10 to 0.6 percent, manganese 0.2 to 0.5 percent, phosphorus not exceeding 0.025 percent, sulphur not exceeding 0.02 percent and copper not exceeding 0.2 percent and remainder iron. Though yttrium and cerium may be both present at a time in this steel, the presence of yttrium alone in amount of 0.05 to 0.02 percent is desirable, when this steel is used for the manufacture of intermediate products of large dimensions.

Steel according to the present invention is commonly melted in the electric arc furnaces on clean charge materials.

To improve ductility desirable when producing intermediate products of large dimensions, at least one of the rare-earth elements (yttrium, lanthanum, cerium) in amount of 0.05 to 0.15 percent is added either in the molten bath before the furnace is tapped or in the ladle when tapping. A heat is tapped into a slagged ladle only. For ingots of 1 to 15 tons in weight, casting in ingot moulds is carried out via bottom gate. Flow of metal is blasted with argon when casting. Another method for producing ingots of steel according to the present invention is electroslag remelt permits the production of metal free of nonmetallic impurities. To this end, the metal melted in the electric arc furnaces is casted via bottom gate into slag moulds to produce ingots of 11 to 15 tons in weight which then are rolled into slab-electrodes followed by remelting into ingots of 4 to 13 tons in weight by means of electroslag remelt.

Steel produced in the form of ingots is cooled in the ingot moulds, whereas ingots produced by means of electroslag remelt is cooled in crystallizers to the temperature of 100° C., then they are extracted out of the ingot mould or crystallizer and charged into a furnace for the first stage of tempering at a temperature of 650° C. The first stage of tempering is followed by cooling of the ingots to 20°–30° C. and subsequent final tempering thereof at 635° C. (second stage of tempering).

Intermediate products produced of steel according to the present invention are as follows: circular, square and octahedral ingots of 1 to 15 tons in weight produced by means of open electric are melting; square and rectangular ingots of 4 to 13 tons in weight produced by means of electroslag remelt; forged pieces up to 15 tons fabricated of open electric arc melted ingots as well as of electroslag remelt ingots; circular rods of 30 to 180 mm in size, produced of open electric arc melted ingots as well of electroslag remelt ingots; circular and square forged pieces of 180 to 400 mm in size fabricated of electroslag remelt ingots; slabs of 200 mm in thickness, 800 mm in width and 2000 mm in length, and welding wire of 1.5 to 5.0 mm in diameter.

Thermal treating of a steel according to the present invention is carried out as follows. Ingots after being casted, forged pieces at forging temperatures or articles at hardening temperatures are cooled to temperatures laying in martensitic transformation start-end interval which provides a partial transformation of austenite to martensite only, followed by immediately heating up to temper temperatures from 600° to 650° C. (first stage of transformation and tempering) then cooling is carried out to more lower temperatures, however also laying within startend interval of martensite transformation followed by heating to tempering temperatures (second stage of transformation and tempering) and so on, thereby decreasing cooling temperature with each time till it becomes equal or somewhat lower than the temperature of the martensite transformation end; i.e. till to essentially complete transformation of austenite to martensite. Then final tempering at temperatures of 600°–650° C. follows. Number of stages of transformation and temper required is determined from massiveness of ingots, forged pieces and parts and intricacy of their shape (the number should not be less than two), whereas cooling temperatures from the start-end interval of martensite transformation are chosen such as somewhat equal amount of martensite there produced with each cooling stage.

In general, it is practicable, when carrying out thermal treatment of intricate shape intermediate products of more than 0.5 ton in weight produced of corrosion-resistant weldable martensitic steel according to the present invention, to accomplish two-stage transformation and temper of the products with cooling to 100° C. at the first stage and subsequent tempering at 650° C. followed by second cooling to 20°–30° C. at the second stage and subsequent tempering at 635° C. It is possible, however to carry out thermal treatment comprising more than two stages.

Characteristic examples illustrative of particular aspects of the present invention and clearly demonstrating its features and advantages are given below.

EXAMPLE 1

In Table 1 there are given the chemical ingredients of three steels according to the present invention and of one of the steel outside of the invention, with molybdenum present in amount of 1.2 to 2.0 percent. In corrosion-resistant weldable martensitic steels according to the present invention molybdenum is present in but residual amounts.

Comparative mechanical properties of the three steels at 20° and 350° C., particularly the tensile strength in kilograms per square millimeter, the 0.2 percent yield strength in the same terms, the elongation and reduction in area in percent determined on fivefold length specimens, and also impact strength in kilogram-meters per square centimeter at room temperature determined on speciments in size of 10×10×55 mm with semicircular notch of 2 mm in depth and notch radius of 1 mm, and V-notch with angle of 45° and notch radius of 0.25 mm are set out in Table 2.

TABLE 1

| Relative Heat No. | Chemical composition (weight percent) | | | | | | | | | | | |
|---|---|---|---|---|---|---|---|---|---|---|---|---|
| | C | Cr | Ni | Mn | Si | Nb | Mo | Y | Cu | S | P | Fe |
| 1 | 0.08 | 15.4 | 4.4 | 0.31 | 0.25 | 0.3 | — | 0.05 | 0.06 | 0.012 | 0.012 | remainder |
| 2 | 0.08 | 16.2 | 3.9 | 0.35 | 0.45 | 0.37 | — | 0.10 | 0.08 | 0.008 | 0.012 | remainder |
| 3 | 0.06 | 15.5 | 4.12 | 0.27 | 0.32 | 0.27 | — | 0.15 | 0.10 | 0.010 | 0.015 | remainder |
| 4* | 0.05 | 13.45 | 4.35 | 0.52 | 0.24 | — | 1.56 | — | — | 0.007 | 0.015 | remainder |

*Outside invention

TABLE 2

| Relative Heat No. | MECHANICAL PROPERTIES** | | | | | | | | | |
|---|---|---|---|---|---|---|---|---|---|---|
| | at 20° C. | | | | | | at 350° C. | | | |
| | Tensile strength kgf/mm² | 0.2% yield strength kgf/mm² | Elongation % | Reduction in area % | Impact strength kgf . m/cm² R = 1 mm | Impact strength kgf . m/cm² R = 0.25 mm | Tensile strength kgf/mm² | 0.2% yield strength kgf/mm² | Elongation % | Reduction in area % |
| 1 | 99.3 | 82.4 | 19.1 | 66.3 | 17.0 | 13.2 | 83.0 | 76.2 | 12.4 | 63.1 |
| 2 | 103.0 | 83.0 | 18.4 | 65.3 | 17.4 | 14.1 | 84.1 | 77.0 | 12.0 | 64.2 |
| 3 | 97.0 | 79.0 | 18.2 | 54.2 | 15.0 | 11.0 | 77.4 | 72.1 | 13.0 | 62.4 |
| 4* | 85.7 | 73.7 | 19.8 | 50.5 | 17.5 | — | 71.3 | 61.1 | 12.7 | 45.2 |

*Outside invention
**Averaged over test data of three specimens

The mechanical properties of the three steels according to the present invention were determined subsequent to thermal treatment comprising oil hardening at 1050° C. and temper at 650° C., whereas mechanical properties of the steel outside the invention were determined subsequent to oil hardening at 990° C. and temper at 600° C.

It should be noted that the steel according to the present invention has an elevated strength level both at room temperature and a temperature of 350° C. as compared to the known steel (cf. heat No. 4), despite to an increased temper temperature.

For the three heats according to the present invention, the tensile strength varies within the range from 97 to 103 kilograms per square millimeter, the 0.2 percent yield strength is in the range from 79 to 83 kilograms per square millimeter as compared to the known steel (cf. heat No. 4) having the tensile strength of 85 kilograms per square millimeter and 0.2 percent yield strength of 71 kilograms per square millimeter. The remaining values of the mechanical properties are given in Table 2.

Steel according to the present invention is conveniently melted in the electric arc furnaces. Where desired, ingots of said steel may be produced by means of electroslag remelt. The furnace is tapped, the metal is teemed into ingot moulds, and the metal is then processed from ingot into forged pieces, slabs and section steel. The metal readily lends itself to hot plastic treatment and works well in the press and mill. The slabs may be converted into sheet, strip down to 40 millimeters in thickness or wire down to 5 millimeters in diameter.

Figures 2A, 2B, 2C, 2D, 2E, 2F:
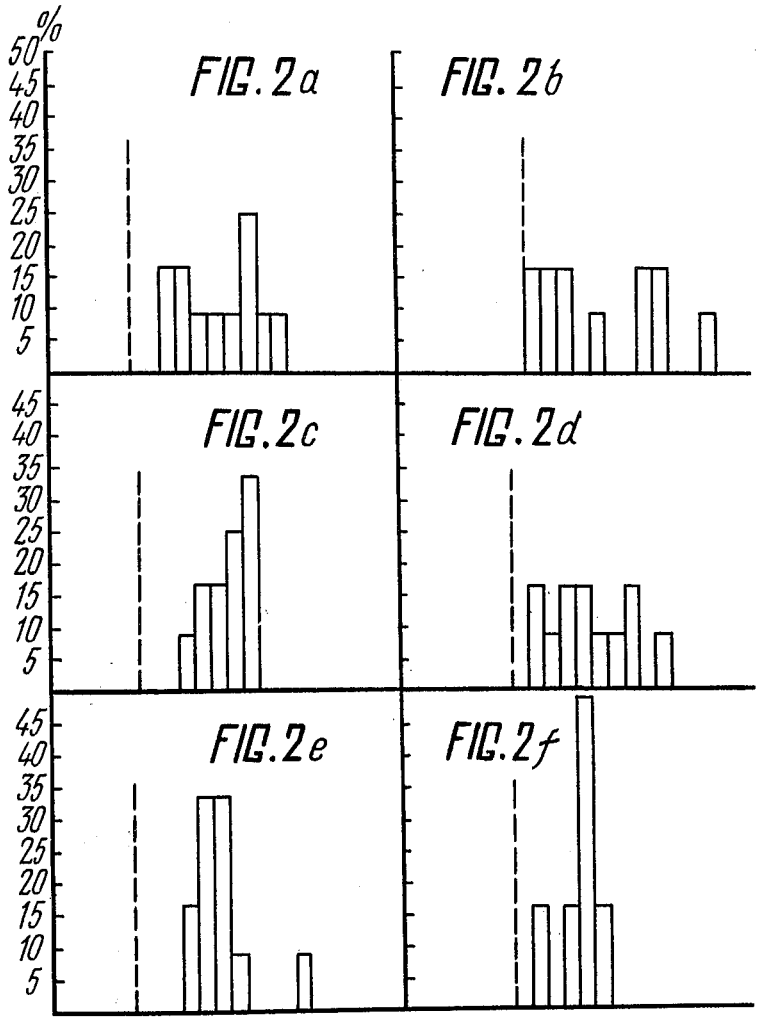

As particularly illustrative of the steel according to the present invention, especially the mechanical properties of forged pieces fabricated in industry, there is given in Table 3 the chemical composition and in FIG. 1 statistical data of the mechanical properties, namely the tensile strength, the 0.2 percent yield strength, the elongation, the reduction in area, and the impact strength determined on specimens with semicircular notch-from test data of 132 forged pieces fabricated of ingots of 2.1 to 2.8 tons, and in FIG. 2, statistical data of the mechanical properties, namely the tensile strength, the 0.2 percent yield strength, the elongation, the reduction in area and the impact strength determined on specimens with semicircular notch and V-notch-from test data of 14 forged pieces fabricated of ingots of 12.0 to 13.7 tons in weight. Determination of the mechanical properties of the forged pieces are accomplished on longitudinal specimens subsequent to thermal treatment comprising oil hardening at 1050° C. and temper at 635°–650° C.

TABLE 3

| Relative Heat No. | Chemical composition (weight percent) | | | | | | | | | | |
|---|---|---|---|---|---|---|---|---|---|---|---|
| | C | Cr | Ni | Mn | Si | Nb | Y | Cu | S | P | Fe |
| 5 | 0.09 | 16.14 | 4.4 | 0.37 | 0.25 | 0.30 | 0.07 | 0.06 | 0.005 | 0.007 | remainder |
| 6 | 0.10 | 15.45 | 4.23 | 0.44 | 0.27 | 0.33 | 0.09 | 0.08 | 0.005 | 0.019 | remainder |
| 7 | 0.09 | 15.65 | 4.03 | 0.37 | 0.28 | 0.25 | 0.08 | 0.10 | 0.013 | 0.013 | remainder |
| 8 | 0.08 | 15.75 | 4.08 | 0.27 | 0.27 | 0.30 | 0.06 | 0.05 | 0.008 | 0.012 | remainder |
| 9 | 0.08 | 15.82 | 4.16 | 0.43 | 0.24 | 0.37 | 0.10 | 0.08 | 0.009 | 0.010 | remainder |
| 10 | 0.06 | 15.5 | 4.12 | 0.27 | 0.32 | 0.27 | 0.08 | 0.08 | 0.010 | 0.015 | remainder |
| 11 | 0.09 | 15.74 | 4.04 | 0.33 | 0.30 | 0.28 | 0.13 | 0.08 | 0.014 | 0.010 | remainder |
| 12 | 0.09 | 15.46 | 4.30 | 0.30 | 0.37 | 0.25 | 0.07 | 0.06 | 0.010 | 0.010 | remainder |

*4 to 14 ingots are produced of each heat

In reviewing the data presented above it will be seen that the steel according to the present invention produced as forged pieces fabricated of ingots up to 13.7 tons in weight has a tensile strength of at least 92 kilograms per square millimeter, a 0.2 percent yield strength of at least 75 kilograms per square millimeter, an elongation of at least 11 percent, a reduction in area of at least 51 percent, an impact strength determined on specimens with semicircular notch of at least 12 kilogram-meters per square centimeter and that determined on specimens with V-notch of at least 7 kilogram-meters per square centimeter.

Likewise, in other examples illustrative of the steel according to the present invention, the material with more restricted contents of carbon, niobium, silicon and also with additions of rareearth elements (lanthanum, cerium) and transition group metals (zirconium) enjoys the mechanical properties of the same level as described in this example.

EXAMPLE 2

The chemical composition of three corrosion-resistant weldable martensitic steels, in which, as compared to the steel presented in the Example 1, silicon content is limited to 0.20 percent maximum lanthanum in amount of 0.05 to 0.15 percent is added, and also contents of nonferrous impurities, sulphur and phosphorus, are limited, particularly, copper to 0.1 percent maximum, each of tin, antimony and arsenic to 0.01 percent maximum, sulphur to 0.015 percent maximum, phosphorus to 0.02 percent maximum is given in Table 4.

TABLE 4

| Relative Heat No. | Chemical composition (weight percent) | | | | | | | | | | | | | | |
|---|---|---|---|---|---|---|---|---|---|---|---|---|---|---|---|
| | C | Si | Mn | Cr | Ni | P | S | Nb | Y | La | Cu | Sn | Sb | As | Fe |
| 13 | 0.06 | 0.05 | 0.30 | 15.10 | 3.5 | 0.006 | 0.005 | 0.25 | 0.05 | 0.05 | 0.01 | 0.002 | 0.001 | 0.003 | remainder |
| 14 | 0.08 | 0.12 | 0.43 | 16.05 | 4.03 | 0.010 | 0.011 | 0.33 | 0.07 | 0.10 | 0.08 | 0.005 | 0.005 | 0.007 | remainder |
| 15 | 0.10 | 0.20 | 0.5 | 16.5 | 4.4 | 0.010 | 0.015 | 0.40 | 0.10 | 0.15 | 0.10 | 0.010 | 0.010 | 0.010 | remainder |

Comparative mechanical properties of these three steels in starting thermal treatment condition (oil hardening at 1050° C. and tempering at 650° C.) and subsequent to irradiation by flux of $1.4 \cdot 10^{20}$ neutrons per square centimeter, particularly the tensile strength in kilograms per square millimeter, the 0.2 percent yield strength in the same terms, the elongation in percent determined on fivefold length specimens, the impact strength determined on specimens of $10 \times 10 \times 55$ mm in size with V-notch of 45° and notch radius of 0.25 mm in kilogram-meters per square centimeter, and also brittleness critical temperature values in Celsius degrees prior and subsequent to the irradiation, and irradiation embrittlement ratio values are given in Table 5.

TABLE 5

| Relative heat No. | Irradiation conditions | | Mechanical properties at 20° C. | | | | Brittlement critical temperature* °C. | Brittlement critical temperature shift °C. | Irradiation embrittlement ratio** |
|---|---|---|---|---|---|---|---|---|---|
| | Temperature °C. | Flux neutron/cm$^2$ | Tensile strength kgf/mm$^2$ | 0.2% yield tensile kgf/mm$^2$ | Elongation % | Impact strength kgf . m/cm$^2$ | | | |
| | — | — | 94.4 | 78.0 | 18.0 | 20.0 | −100 | — | — |
| 13 | 270–350 | $1.4 \cdot 10^{20}$ | 108.0 | 89.0 | 16.0 | 17.5 | −60 | 40 | 7.7 |
| | — | — | 96.0 | 83.0 | 15.5 | 16.5 | −60 | — | — |
| 14 | 270–350 | $1.4 \cdot 10^{20}$ | 104.5 | 95.0 | 14.0 | 15.0 | −40 | 20 | 3.8 |
| | — | — | 102.5 | 89.4 | 13.3 | 14.0 | −90 | — | — |
| 15 | 270–350 | $1.4 \cdot 10^{20}$ | 110.0 | 98.0 | 12.5 | 11.0 | −50 | 40 | 7.7 |

*Brittleness critical temperature was determined from impact strength having average amounts of 6.0 kilogram-meters per square centimeter with allowance for minimum value of 4.2 kilogram-meters per square centimeter.

**Irradiation embrittlement ratio (A) was determined from the formula $$A = \frac{\Delta Tc}{F^{\frac{1}{3}}}$$

where Δ Tc - brittlement critical temperature shift

F - integral dose multiple to $10^{18}$.

It is noted from the information presented in Table 5 that the mechanical properties of the steel according to the present invention in starting thermal treatment condition are at a level of the properties of the steel according to Table 2. Subsequent to irradiation with flux of $1.4 \cdot 10^{20}$ neutron/cm$^2$ at 270°–350° C. some strengthening develops concurrently with modest decrease of the elongation and impact strength of the steel. As this takes place, the tensile strength rises from 94.4–102.5 to 104.5–110.0 kilograms per square millimeter, the 0.2 percent yield strength rises from 78.0–89.4 to 89–98 kilograms per square millimeter, the elongation drops from 13.3–18.0 to 12.5–16.0 percent, the impact strength drops from 14.0–20.1 to 11.0–17.5 kilogram-meters per square centimeter and the brittlement critical temperature rises from (−60)−(−100) to (−40)−(−60) Celsius degrees.

EXAMPLE 3

The chemical composition of three heats of corrosion-resistant weldable martensitic steel which lends itself to use as a welding wire, according to the present invention, is given in table 6.

Compared to the steel of Example 1 it has somewhat restricted carbon content in amount of 0.06 to 0.07 percent, silicon in amount of 0.3 to 0.6 and zirconium and cerium are added in amounts of 0.05 to 0.20 percent and 0.05 to 0.15 percent, respectively.

Blanks of steel according to the present invention of 150 mm in thickness are welded by means of argon-arc welding. The mechanical properties at 20° and 350° C. of the base metal and the weld joint produced with use of the welding wire according to the present invention, namely the tensile strength in kilograms per square millimeter, the 0.2 percent yield strength in the same terms, the elongation and reduction in area in percent determined on specimens of fivefold length, and also the impact strength at room temperature determined on notched specimens of 10×10×55 mm in size with semicircular notch of 2 mm in depth and 1 mm in notch radius in kilogram-meters per square centimeter, are given in Table 7.

It is noted from the information presented in Table 7 that the weld joint accomplished with use of the welding wire according to the present invention is practically equivalent to the base metal, particularly at room temperature tests, and has the ductility and impact strength of the same values as the base metal. For instance, the tensile strength of the weld joint at room temperature is 96.1 kilograms per square millimeter, compared to 99.2 kilograms per square millimeter of the base metal. Values of elongation, reduction in area and impact strength of the weld joint are close to those of the base metal in ranges of 18.6 to 18.8 percent, 70.0 to 70.9 percent and 20.3 to 21.9 kilogram-meters per square centimeter, respectively. When testing at 350° C. the difference in the strength properties of the weld joint and those of base metal is somewhat more considerable. For instance, a tensile strength of the weld joint at 350° C. is 79.2 kilograms per square millimeter as compared to 86 kilograms per square millimeter of the base metal. Nevertheless, absolute values of the strength properties of the weld joint are high enough and ensure practically equistrength to the base metal.

Melting methods for said steel are the same as for that described in the Example 1 and comprise melting of the steel in the electric arc furnaces. After the furnace is tapped the melted metal is teemed into ingot moulds and the ingot is then fabricated into a sheet bar which is rolled in the hot mill into a wire of 6 mm in diameter followed by stretching in the wire mill into a wire of 1.5 to 5.0 mm.

EXAMPLE 4

In table 8 the chemical composition of steel heats according to the present invention is given, in which, as compared to the steel of Example 1, carbon content is restricted to amount of 0.06 to 0.08 percent and niobium content is restricted to amount of 0.32 to 0.40 percent which ensures the niobium to carbon ratio of at least 4:1. To compare with there are some steels also melted, which steels have carbon and niobium contents in the ranges of the Example 1, namely carbon of 0.06 to 0.10 percent and niobium of 0.25 to 0.40 percent.

TABLE 6

| Material | Relative heat No. | Chemical composition | | | | | | | | | | | | |
|---|---|---|---|---|---|---|---|---|---|---|---|---|---|---|
| | | C | Cr | Ni | Mn | Si | Cu | Nb | Zr | S | P | Y | Ce | Fe |
| Welding wire | 16 | 0.06 | 16.4 | 4.4 | 0.46 | 0.60 | 0.05 | 0.40 | 0.20 | 0.007 | 0.010 | 0.20 | 0.15 | remainder |
| Base metal | 17 | 0.09 | 15.4 | 4.3 | 0.31 | 0.39 | 0.06 | 0.37 | — | 0.008 | 0.013 | 0.07 | — | remainder |
| Weld metal | 18 | 0.06 | 16.2 | 4.4 | 0.49 | 0.58 | 0.06 | 0.38 | 0.18 | 0.007 | 0.011 | 0.15 | 0.12 | remainder |

TABLE 7

| Material | Relative heat No. | Mechanical properties | | | | | | | | |
|---|---|---|---|---|---|---|---|---|---|---|
| | | at 20° C. | | | | | at 350° C. | | | |
| | | Tensile strength kgf/mm$^2$ | 0.2% yield strength kgf/mm$^2$ | Elongation % | Reduction in area % | Impact strength kgf . m/cm$^2$ | Tensile strength kgf/mm$^2$ | 0.2% yield strength kgf/mm$^2$ | Elongation % | Reduction in area % |
| Weld joint | 18 | 96.1 | — | 18.6 | 70.0 | 21.9 | 79.2 | — | 15.8 | 67.3 |
| Base metal | 17 | 99.2 | 83.7 | 18.8 | 70.9 | 20.3 | 86.0 | 82.0 | 13.1 | 67.8 |

Note:
1. Test data are averaged over three specimens.
2. Specimens were tested subsequent to thermal treatment comprising oil hardening at 1050° C. and temper at 650° C.
3. Specimens were cut out transversely to the weld. Impact strength test notch in the specimens is accomplished in weld metal.

A group of heats also melted, which heats have carbon and niobium contents outside of the present invention. In all of these heats the contents of the essential alloys, i.e. chromium and nickel, were somewhat equal and ranged from 15.0 to 16.5 and 3.73 to 4.35 percent respectively, whereas the niobium to carbon ratio varied from 0.8 to 4.6.

Inclination of the steel to intercrystalline corrosion and corrosion cracking were determined from said heats.

Inclination to intercrystalline corrosion was determined subsequent to exposure for 24 hours in boiling solution of blue vitriol and sulphuric acid with presence of copper chip. Intercrystalline ruptures (as relative to initial austenite grain) were identified with appearance of cracks upon bending of specimens through 90 deg and by means of metallographic analyses. Flat specimens in size of 2×6×80, 2×20×90, 2×10×70 mm with a constant given deformation in pure bending zone were subjected to corrosion cracking test. The specimens upon initial given stresses amounting to 0.8 of 0.2 percent yield strength were subjected to exposure in distillate with chlorides and oxygen contents of 0.05 mg/kg each with or no addition (12 g/kg) of boric acid at temperatures of 200° to 350° C., in 0.5 percent NaCl solution at 100° C., and in vapor of boiling 10 percent NaCl solution at 200° C.

TABLE 8

| Relative heat No. | Chemical composition (weight percent) C | Cr | Ni | Nb | Nb/C ratio |
|---|---|---|---|---|---|
| I-1* | 0.10 | 15.10 | 4.26 | 0.08 | 0.80 |
| I-2* | 0.12 | 15.88 | 4.34 | 0.10 | 0.83 |
| I-3* | 0.11 | 15.00 | 4.13 | 0.10 | 0.91 |
| I-4* | 0.11 | 15.60 | 4.30 | 0.11 | 1.00 |
| II-1* | 0.07 | 15.57 | 4.20 | 0.09 | 1.28 |
| II-2* | 0.09 | 16.45 | 4.23 | 0.13 | 1.45 |
| II-3* | 0.08 | 16.44 | 4.25 | 0.14 | 1.75 |
| II-4* | 0.09 | 15.46 | 4.35 | 0.20 | 2.20 |
| II-5* | 0.05 | 16.25 | 3.94 | 0.12 | 2.40 |
| II-6* | 0.06 | 14.70 | 3.30 | 0.17 | 2.84 |
| II-7* | 0.06 | 16.20 | 4.11 | 0.18 | 3.00 |
| III-1 | 0.09 | 15.74 | 4.04 | 0.28 | 3.10 |
| III-2 | 0.09 | 15.73 | 3.73 | 0.33 | 3.70 |
| III-3 | 0.08 | 15.75 | 4.08 | 0.30 | 3.80 |
| III-4 | 0.08 | 16.50 | 3.90 | 0.32 | 4.00 |
| III-5 | 0.06 | 15.50 | 4.12 | 0.27 | 4.50 |
| III-6 | 0.08 | 15.38 | 4.26 | 0.37 | 4.60 |

*Outside invention

Corrosion cracking resistance was assessed with time duration up to the moment of a first crack appearance visible at 16× magnification.

Figure 3:
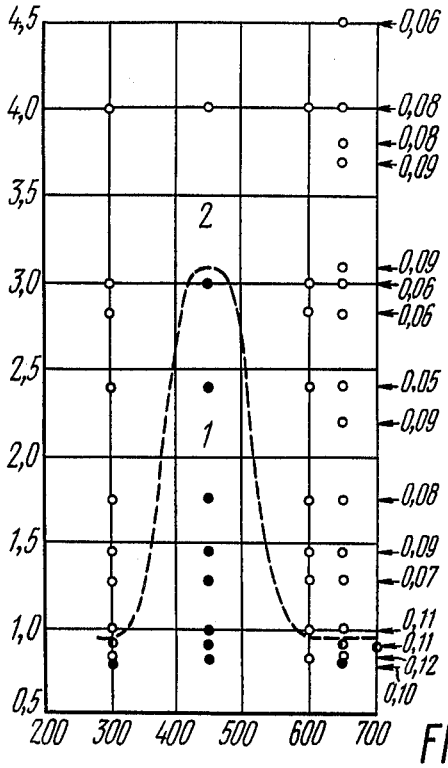

Data illustrative of temper temperature and the Nb/C ratio effect upon inclination of heats investigated to intercrystalline corrosion (each point represents test data from 3–4 specimens), are given in FIG. 3. It is to be seen from FIG. 3 that with a carbon content of more than 0.1 percent and a niobium content of less than 0.1 percent, i.e. with the niobium to carbon ratio of less than 1.0, the steel inclines to intercrystalline corrosion in the temperature range of 300° to 700° C. independent of temper temperature (oil hardening at 1050° C.). With a carbon content of less than 0.1 percent and an elevated niobium content up to 0.18 percent the temperature range where the steel inclines to intercrystalline corrosion is restricted. In this case, the heats with a carbon content of 0.05 to −0.09 percent and a niobium content of 0.09 to 0.18 percent, i.e. with the niobium to carbon ratio of 1.0 to 3.0, all incline after temper at provocative temperature of 450° C. to intercrystalline corrosion. With a niobium content of more than 0.25 percent and a carbon content of less than 0.1 percent. i.e. with the niobium to carbon ratio of more than 3.0 steel according to the present invention shows no more inclination to intercrystalline corrosion. For instance, a steel with a niobium content of 0.32 percent and a carbon content of 0.08 percent, that is, with the niobium to carbon ratio of 4.0, shows no inclination to intercrystalline corrosion not only subsequent to optimum thermal treatment comprising oil hardening at 1050° C. and temper at 650° C., but also after provocative heating at 450° C.

To suppress inclination to intercrystalline corrosion the niobium to carbon ratio must amount of not less than 10.0 for the type 18-8 austenitic steels, whereas it must be of not less than 28 for the type 20–45 alloys of high nickel content. A decreased niobium to carbon ratio of not less than 3.0 required to stabilize a corrosion-resistant steel according to the present invention, as compared to that of austenitic steel, is attributed to a more disperse structure of martensite, a great deal of phase boundaries, and a less solubility of carbideforming elements in ferrite as compared to austenite.

Figure 4A:
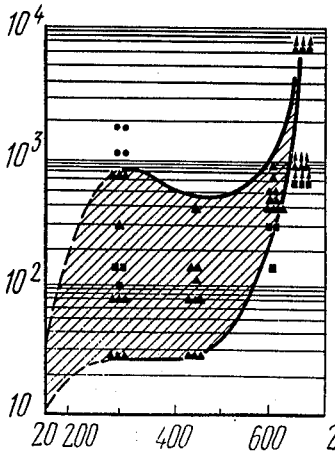
Figure 4B:
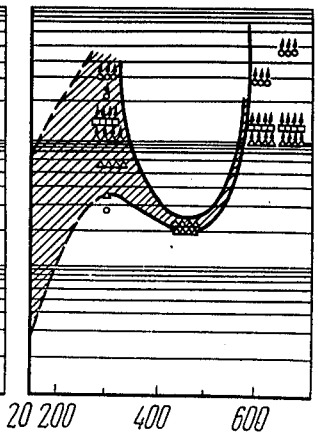

It is to be seen from FIG. 4 that endurance of steel specimens with the niobium to carbon ratio equal to 4.0 at any temper temperature is higher than that of a steel with the niobium to carbon ratio ranging from 0.83 to 1.75. Subsequent to temper at 300° C. corrosion cracking tests show considerable variability of results. The least resistance is observed subsequent to temper at 450° C. The temper temperature increase up to 600° C. does not overcome inclination of a steel with the niobium to carbon ratio of 0.83 to 1.75 to corrosion cracking and it is not until subsequent to temper at 650° C. that a marked improvement of the resistance is observed. As for steels with the niobium to carbon ratio of 4.0, their resistance rises markedly even subsequent to temper at 600° C.

Melting processes for said steel are the same as for the steel described in the Example 1 and comprise melting of the steel in the electric arc furnaces as well as producing of ingots by means of electroslag remelt. After the melting is over, the melted metal is teemed into ingot moulds or remelted in crystallizers. The ingots are then converted into forged pieces, slabs, and shape stock.

EXAMPLE 5

As illustrative of properties of the steel according to the present invention and effect of the chemical composition of this steel upon the mechanical properties and the impact strength under conditions of prolonged use at elevated temperatures, four heats of chromium-nickel martensitic steels of closely related chemical compositions are given in Table 9. Three of these heats answer to the requirements of the present invention, while the remaining one of rather similar composition differs therefrom.

In Table 9 there are presented compositions of steels comprising chromium of 13.45 to 15.78 percent and nickel of 3.9 to 5.35 percent. The heat, which is outside the present invention, further comprises molybdenum in amount of 1.56 percent. The mechanical properties of these steels and the heat embrittlement resistance thereof following prolonged exposure for 500–10,000 hours at a temperature of 340° C. are set forth in Table 10. This Table presents the mechanical properties and impact strength of steels following thermal treatment comprising oil or water hardening at 990°–1050° C. and temper at 600°-650° C. for 2-12 hours, both prior to exposure to elevated temperature and following exposure for 500-10,000 hours at a temperature 340° C. In the table the tensile strength, the 0.2 percent yield strength, the elongation, and the reduction in area, all determined on fivefold length specimens, and the impact strength determined on notched specimens in size of 10×10×55 mm with semicircular notch of 2 mm in depth and notch radius of 1 mm and V-notch with notch radius of 0.25 mm are presented.

It is to be seen from Table 10 that ductility of the steel, namely the elongation and the reduction in area varies but slightly following prolonged exposures at 340° C., whereas strength level somewhat rises. Thus, the tensile strength of the heats tested increases from 85.7-102.3 kilograms per square millimeter (in initial conditions) to 91.3-115.0 kilograms per square millimeter (subsequent to exposure for 500-10,000 hours at 340° C.), whereas the 0.2 percent yield strength rises from 73.7-83.7 kilograms per square millimeter (in initial conditions) to 77.7-105.2 kilograms per square millimeter (subsequent to exposure for 500-10,000 hours at 340° C.). The impact strength of the steel somewhat drops following prolonged heat exposures. Impact strength values following exposure for 500-10,000 hours at 340° C. drop from 12.2-20.5 kilogram-meters per square centimeter to 10.6-16.4 kilogram-meters per square centimeter for the specimens with notch radius of 1.0 mm and from 8.1-16.4 kilogram-meters per square centimeter to 7.2-13.5 kilogram-meters per square centimeter for the specimens with notch radius of 0.25 mm (in initial conditions).

Roentgenographic analysis of the specimens on a diffractometer with FeK$\alpha$ irradiation shows that austenite content in the structure falls after prolonged exposures at 340° C. It falls from 16 percent (in initial conditions) to 8-10 percent for the heat 21 steel, which evidences destabilization of austenite (upon additional heatings) a part of which is transformed into untempered martensite following cooling below the martensite transformation start temperature. Additional prolonged exposures at 340° C. also result in decomposition of solid solution. Physicochemical and X-ray analysis in CuK$\alpha$irradiation show that carbides of cement type (Fe, Cr)$_3$C fall out in the steel structure according to the present invention upon heating at 340° C.

TABLE 9

| Relative heat | Chemical composition (weight percent) | | | | | | | | | | |
|---|---|---|---|---|---|---|---|---|---|---|---|
| No. | C | Cr | Ni | Mn | Si | Nb | Cu | Y | S | P | Fe |
| 19* | 0.09 | 15.38 | 4.26 | 0.31 | 0.39 | 0.37 | 0.06 | 0.07 | 0.008 | 0.013 | Remainder |
| 20* | 0.08 | 15.75 | 4.08 | 0.27 | 0.27 | 0.30 | 0.05 | 0.10 | 0.008 | 0.012 | Remainder |
| 21** | 0.08 | 15.78 | 3.90 | 0.27 | 0.35 | 0.25 | 0.07 | 0.05 | 0.008 | 0.024 | Remainder |
| | | | | | | Mo | Al | | | | |
| *** | 0.05 | 13.45 | 5.35 | 0.52 | 0.24 | 1.56 | 0.17 | — | 0.007 | 0.015 | Remainder |

*Steels according to the invention
**Steel according to the invention enjoying a best combination of properties following prolonged heatings.
***The type 2RMO steel, outside invention.

TABLE 10

| Prolonged heating | | | Mechanical properties at 20° C. | | | | | |
|---|---|---|---|---|---|---|---|---|
| | | | | | | | Impact strength kgf,m/cm$^2$ | |
| Temperature °C. | Duration hours | Relative heat No. | Tensile strength kgf/mm$^2$ | 0.2% yield strength kgf/mm$^2$ | Elongation % | Reduction in area % | Radius = 1.0 mm | Radius = 0.25 mm |
| 1 | 2 | 3 | 4 | 5 | 6 | 7 | 8 | 9 |
| Initial conditions: oil hardening at 1050° C. + temper at 650° C., 2 hours, air | | 19 | 99.2 | 83.7 | 18.8 | 70.9 | 20.3 | 16.4 |
| Initial conditions: oil hardening at 1050° C. + temper at 580° C. 6 hours + 645° C., 12 hours | | 20 | 95.0 | 74.0 | 19.0 | 58.0 | 12.2 | 8.1 |
| Initial conditions: oil hardening at 1050° C. + temper at 650° C., 2 hours, air | | 21 | 102.3 | 81.5 | 19.2 | 67.3 | 20.5 | 15.0 |
| Initial conditions: water hardening at 990° C. + temper at 620° C., 6 hours | | | 85.7 | 73.7 | 19.8 | 50.5 | 17.5 | — |
| | 500 | 21 | 105.8 | 101.2 | 17.6 | 64.3 | 15.7 | 13.5 |
| | 1000 | 19 | 103.8 | 95.8 | 17.9 | 65.5 | 16.4 | 10.4 |
| | | 20 | 93.3 | 77.7 | 21.2 | 64.0 | 12.6 | 8.0 |
| | | 21 | 106.4 | 100.2 | 20.1 | 63.4 | 13.2 | 10.5 |
| | | | 91.3 | 82.4 | 17.8 | 54.3 | 11.4 | — |
| 340 | 3000 | 19 | 103.7 | 95.5 | 20.1 | 66.4 | — | — |

TABLE 10-continued

| Prolonged heating | | | Mechanical properties at 20° C. | | | | | |
|---|---|---|---|---|---|---|---|---|
| | | | Tensile | 0.2% yield | | Reduction | Impact strength kgf,m/cm² | |
| Temperature °C. | Duration hours | Relative heat No. | strength kgf/mm² | strength kgf/mm² | Elongation % | in area % | Radius = 1.0 mm | Radius = 0.25 mm |
| 1 | 2 | 3 | 4 | 5 | 6 | 7 | 8 | 9 |
| | | 21 | 108.6 | 103.3 | 19.0 | 62.3 | 14.8 | 13.5 |
| | | | 93.1 | 81.2 | 17.3 | 52.2 | 10.9 | — |
| | 5000 | 20 | 97.7 | 83.3 | 20.8 | 64.0 | 11.8 | 7.2 |
| | | 21 | 115.0 | 105.2 | 18.0 | 58.5 | 13.8 | 12.3 |
| | | | 95.6 | 85.6 | 19.2 | 54.2 | 10.6 | — |
| | 10000 | 20 | 98.3 | 83.0 | 20.2 | 62.0 | 10.9 | — |
| | | 21 | — | — | — | — | 13.2 | — |

*Averaged over test data of three specimens

Thus, decomposition of the supersaturated solid solution upon prolonged heating at 340° C. and appearance of untempered martensite transformed upon cooling from austenite destabilized upon additional heatings result in aforementioned decrease of the impact strength of the steel.

Figure 5:
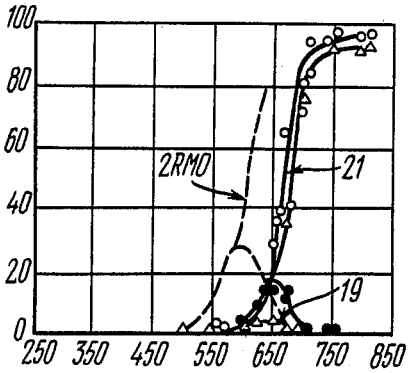

The type 2RMO steel which is outside the present invention shows the most decrease of impact strength values. It is because the type 2RMO steel comprises up to 25–30 percent of austenite (FIG. 5) subsequent to optimum thermal treatment consisting of hardening at 990° C. and temper at 620° C. However, such austenite is relatively unstable and much of it is transformed into untempered martensite upon additional prolonged heatings which leads to marked decrease of impact strength values. Austenite content in the steel according to the present invention subsequent to optimum thermal treatment consisting of hardening at 1050° C. and temper at 650° C. is decreased to amount about 1015 percent. In this case, the degree of decomposition of austenite upon additional prolonged heatings is lowered. Related to this is a diminished fall of impact strength values upon prolonged heat exposure, and hence, an increased heat embrittlement resistance. Of steels according to the present invention, the steel of heat 21 having the least nickel content (3.9 percent) and the somewhat lower niobium content (0.25 percent) with the carbon content of 0.08 percent shows the most improved heat embrittlement resistance. Such a content of said elements is considered as being preferred for parts operating at elevated temperatures for a long time.

EXAMPLE 6

A steel comprising carbon 0.09 percent, manganese 0.33 percent, silicon 0.38 percent, chromium 15.5 percent, nickel 3.86 percent, niobium 0.3 percent, yttrium 0.07 percent, copper 0.12 percent, phosphorus 0.012 percent, remainder iron, is melted in the open electric arc furnace, teemed into ingot moulds of 6.5 and 14.0 tons in capacity, in which crystallization and cooling of ingots to 400° C. (ingot of 14 tons) and to 300° C. (ingot of 6.5 tons) take place. The ingots of 14 and 6.5 tons in weight are then extracted out of the ingot moulds and cooled in air to 100° and 80° C. relatively. After this takes place (not longer than in two hours) the ingots are charged in a furnace heated up to 300° C. (exposure at the charge temperature for two hours) and the temperature of the furnace is then raised to 650° C. at the rate of 50 Celsius degree per hour (first stage of tempering). The exposure duration at 650° C. depends on the charge mass, particularly the exposure lasts for 20 hours for a charge of 40 tons in mass. The 20-hour exposure at 650° C. is followed by cooling of the ingots in the furnace to 300° C. and subsequent air cooling to room temperature. A second stage of tempering begins in two hours at latest subsequent to cooling of the ingots. The second stage comprises charging of the furnace at a temperature not higher than 300° C., exposure at the charge temperature for not less than two hours, heating up to 630° C. at the rate of 50° C. per hour, exposure at 630° C. for 20 hours, cooling within the furnace to 300° C. and then air cooling. Hardness developed in the ingots subsequent to the two-stage tempering is 272–287 HB.

EXAMPLE 7

Six steel heats whose chemical composition is set forth in Table 11 are melted in the open electric arc furnace. The steel is teemed into ingot moulds in capacity of 2.7–2.8, 12.0, 13.0 and 13.7 tons where crystallization of the steel takes place. Subsequent to cooling of the ingots to 100° C. the two-stage tempering is accomplished according to the conditions described in the previous example. The annealed ingots in weight of 2.7–2.8, 12.0, 13.0 and 13.7 tons are then forged at the temperature range of 1200–950° C. followed by collecting of the forged pieces in the furnace at temperatures of 600°–640° C. Subsequent to the collecting of the forged pieces in the furnace their cooling within the furnace is accomplished at the rate in the average of 16° C. per hour to 300° C. followed by air cooling to 100° C. In an hour the forged pieces are charged in the furnace heated up to a temperature of 250°–300° C. followed by rising of the temperature of the furnace up to 650° C. at the rate of 50° C. per hour (first stage of annealing). Exposure duration at 650° C. depends on the charge mass, particularly the exposure lasts for 38 hours for a charge of 75 tons in mass. The 38-hour exposure at 650° C. is followed by cooling of the forged pieces within the furnace to 270° C. and subsequent air cooling to room temperature. In at latest two hours subsequent to cooling of the forged pieces to room temperature they are charged into the furnace for a second stage of annealing.

The second stage of annealing comprises furnace charge at 300° C., exposure for three hours at the charge temperature, heating up to 630° C. at the rate of 50° C. per hour, exposure for 46 hours at 630° C., cooling within the furnace to 350° C. followed by air cooling. Hardness developed in the ingots subsequent to the two-stage annealing is 255–286 HB.

EXAMPLE 8

Three steel heats whose chemical composition is set forth in Table 11 (relative heat Nos. 23, 24, 25) are melted in the open electric arc furnace. The steel is teemed into ingot moulds in capacity of 12.0, 13.0 and 13.7 tons where crystallization of the steel takes place. Subsequent to cooling of the ingots to 100° C. a two-stage tempering is accomplished according to the conditions described in Example 7, the tempered ingots in weight of 12.0, 13.0 and 13.7 tons are then forged at the temperatures range of 1200°-950° C., followed by tempering of the forged pieces according to the conditions described in Example 7.

TABLE 11

| Relative heat No. | Chemical composition (weight percent) | | | | | | | | | | |
|---|---|---|---|---|---|---|---|---|---|---|---|
| | C | Mn | Si | Cr | Ni | Nb | Y | Cu | S | P | Fe |
| 22 | 0.08 | 0.27 | 0.27 | 15.75 | 4.08 | 0.30 | 0.08 | 0.05 | 0.008 | 0.012 | Remainder |
| 23 | 0.09 | 0.38 | 0.36 | 15.73 | 3.73 | 0.33 | 0.07 | 0.10 | 0.011 | 0.010 | Remainder |
| 24 | 0.08 | 0.43 | 0.24 | 15.82 | 4.16 | 0.37 | 0.09 | 0.08 | 0.009 | 0.010 | Remainder |
| 25 | 0.06 | 0.27 | 0.32 | 15.50 | 4.12 | 0.27 | 0.06 | 0.08 | 0.010 | 0.015 | Remainder |
| 26 | 0.09 | 0.33 | 0.30 | 15.74 | 4.04 | 0.28 | 0.11 | 0.08 | 0.014 | 0.010 | Remainder |
| 27 | 0.08 | 0.28 | 0.32 | 16.05 | 4.25 | 0.27 | 0.13 | 0.08 | 0.010 | 0.014 | Remainder |

The tempered forged pieces are subjected to mechanical treatment, sharp angles, sites of surface intersections and edges are therewith rounded. After this takes place, thermal treatment of the forged pieces is accomplished, which forged pieces up to 150 mm in section are subjected to two-stage temper. Said thermal conditions are used for treatment of forged pieces of 510 mm in major diameter, 200 mm in minor diameter and 4000 mm in length. The forged pieces are charged in the vertical furnace at 500° C. for an hour exposure at the charge temperature and subsequent heating for hardening up to 1050° C. is then carried out at a rate permitted with heating capacity of the furnace. Duration of exposure at 1050° C. is determined by the maximum section of a forged piece, particularly exposure lasts for 8 hours for a forged piece of 150 mm in section. Subsequent to the 8-hour exposure at 1050° C. oil hardening of the forged pieces is performed with their cooling in oil to 120° C. and subsequent air cooling to 100° C. In at latest two hours the forged pieces are charged in the furnace heated up to 450° C., followed by heating up to 655° C. at the rate of 40° C. per hour (first stage of temper). Exposure duration at 655° C. is determined by the forged piece maximum section for thermal treatment, particularly exposure at 655° C. lasts, on average, for 16 hours for forged pieces of 150 mm in section. The 16-hour exposure at 655° C. is followed by air cooling of the forged pieces to room temperature. In at latest two hours subsequent to cooling to room temperature the forged pieces are charged into the furnace for a second stage of temper which comprise the charging into the furnace at 300° C., heating up to 635° C. at the rate of 55° C. per hour, exposure for 12 hours at 635° C. followed by air cooling. Forged pieces of 510 mm in major diameter, 200 mm in minor diameter and about 4000 mm in length subjected to said thermal treatment have required values of the mechanical properties: a tensile strength of 93 to 106 kilograms per square millimeter, a 0.2 percent yield strength of 77 to 94 kilograms per square millimeter, an elongation of 14.2 to 20.0 percent, a reduction in area of 46.5 to 61.5 percent, an impact strength determined on specimens with semicircular notch of 10.9 to 16.6 kilogrammeters per square centimeter, an impact strength determined on specimens with V-notch of 5.8 to 11.6 kilogram-meters per square millimeter.

As for forged pieces of 150 mm in section, it is desirable to subject them to at least three-stage temper. In particular, forged pieces of 540 mm in section are subjected to thermal treatment as follows: charging of the forged pieces into the furnace at a temperature of 400° C. to heat them for hardening, exposure for an hour at the charge temperature, heating up to 1050° C. at a rate enabled by heating capacity of the furnace, exposure for 22 hours at 1050° C. The 22-hour exposure at 1050° C. is followed by oil hardening until the temperature on the forged piece surface is brought down to 120° C., then in at latest two hours the charging of the forged pieces into the furnace for a first stage of tempering is carried out, which first stage comprises the charging into the furnace at a temperature of 300° C., exposure for three hours at the charge temperature, heating up to a temperature of 650° C. at the rate of 50° C. per hour, exposure for 24 hours at 650° C., and air cooling of the forged pieces to 70° C. The second stage of tempering comprises charging of the forged pieces cooled to 70° C. into the furnace at 300° C., exposure for two hours at the charge temperature, heating up to 640° C. at the rate of 50° C., exposure for 10 hours at 640° C., and air cooling of the forged pieces to room temperature. The third stage of tempering comprises charging of the forged pieces cooled to room temperature into the furnace at a temperature of 300° C., exposure for two hours at the charge temperature, heating up to a temperature 630° C. at the rate of 50° C. per hour, exposure for 10 hours at 630° C., and air cooling of the forged pieces to room temperature. Forged pieces of 540 mm in section subjected to said thermal treatment have high values of the mechanical properties: a tensile strength of 94 to 99 kilograms per square millimeter, a 0.2 percent yield strength of 77 to 81 kilograms per square millimeter, an elongation of 15.5 to 21.5 percent, a reduction area of 41 to 64 percent, an impact strength determined on specimens with semicircular notch of 9.3 to 17.7 kilogram-meters per square centimeter, and an impact strength determined on specimens with V-notch of 7.0 to 10.9 kilogram-meters per square centimeter.

In the description of the various examples according to the present invention disclosed above, specific narrow terminology has been resorted to for the sake of clarity. It should be understood, however, that the present invention is no way limited to the terms so selected and that each term covers all equivalent elements operating in a similar manner and employed for solving similar problems.

Though the present invention has been described herein with reference to preferred embodiments thereof, it will be understood that minor changes may be made without departing from the spirit and scope of the invention, as be readily understood by those skilled in the art.

We claim:

1. A corrosion-resistant weldable martensitic steel consisting of carbon 0.06 to 0.10 weight percent, chromium 15.1 to 16.5 weight percent, nickel 3.5 to 4.45 weight percent, silicon 0.10 to 0.60 weight percent, manganese 0.20 to 0.50 weight percent, at least one element selected from the group consisting of niobium 0.25 to 0.40 weight percent and zirconium 0.05 to 0.20 weight percent, at least one element selected from the group consisting of yttrium 0.05 to 0.20 weight percent, cerium 0.05 to 0.15 weight percent and lanthanum 0.05 to 0.15 weight percent, phosphorus not more than 0.025 weight percent, sulfur not more than 0.02 weight percent, copper not more than 0.20 weight percent, the remainder being substantially iron and unavoidable nonferrous impurities.

2. A corrosion-resistant weldable martensitic steel consisting of carbon 0.06 to 0.10 weight percent, chromium 15.1 to 16.5 weight percent, nickel 3.5 to 4.45 weight percent, silicon 0.10 to 0.20 weight percent, manganese 0.2 to 0.5 weight percent, yttrium 0.05 to 0.10 weight percent, niobium 0.25 to 0.40 weight percent, lanthanum 0.05 to 0.15 weight percent, phosphorus not exceeding 0.02 weight percent, sulfur not exceeding 0.015 weight percent, copper not exceeding 0.1 weight percent and a minimum amount of nonferrous impurities such as tin, antimony and arsenic each not exceeding 0.01 weight percent, the remainder being substantially iron and unavoidable impurities.

3. A corrosion-resistant weldable martensitic steel consisting of carbon 0.06 to 0.10 weight percent, chromium 15.1 to 16.5 weight percent, nickel 3.5 to 4.45 weight percent, silicon 0.10 to 0.60 weight percent, manganese 0.20 to 0.50 weight percent, at least one element selected from the group consisting of niobium 0.25 to 0.40 weight percent and zirconium 0.05 to 0.20 weight percent, the niobium to carbon ratio being always 4:1, at least one element selected from the group consisting of yttrium 0.05 to 0.20 weight percent, cerium 0.05 to 0.15 weight percent and lanthanum 0.05 to 0.15 weight percent, phosphorus not exceeding 0.025 weight percent, sulfur not exceeding 0.02 weight percent, copper not exceeding 0.20 weight percent, the remainder being substantially iron and unavoidable nonferrous impurities.

4. A corrosion-resistant weldable martensitic steel consisting of carbon 0.06 to 0.07 weight percent, chromium 15.1 to 16.5 weight percent, nickel 3.5 to 4.45 weight percent, silicon 0.3 to 0.6 weight percent, manganese 0.20 to 0.50 weight percent, niobium 0.25 to 0.40 weight percent, zirconium 0.05 to 0.20 weight percent, cerium 0.05 to 0.15 weight percent, yttrium 0.05 to 0.20 weight percent, phosphorus not exceeding 0.025 weight percent, sulfur not exceeding 0.02 weight percent, copper not exceeding 0.20 weight percent, the remainder being substantially iron and unavoidable nonferrous impurities.

* * * * *